US007819625B2

(12) United States Patent
Merrill et al.

(10) Patent No.: US 7,819,625 B2
(45) Date of Patent: Oct. 26, 2010

(54) ABRADABLE CMC STACKED LAMINATE RING SEGMENT FOR A GAS TURBINE

(75) Inventors: Gary B. Merrill, Orlando, FL (US); Steven J. Vance, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 811 days.

(21) Appl. No.: 11/800,787

(22) Filed: May 7, 2007

(65) Prior Publication Data

US 2008/0279678 A1 Nov. 13, 2008

(51) Int. Cl.
*F01D 11/08* (2006.01)

(52) U.S. Cl. ..... 415/170.1; 415/173.1; 415/173.4; 415/173.6; 415/174.4; 415/200

(58) Field of Classification Search ..... 415/170.1, 415/171.1, 173.1, 173.4, 173.5, 173.6, 173.7, 415/174.4, 174.5, 200
See application file for complete search history.

(56) References Cited

U.S. PATENT DOCUMENTS 4,329,308 A * 5/1982 Langer et al. ..... 264/162
4,639,388 A * 1/1987 Ainsworth et al. ..... 415/173.4
4,764,089 A 8/1988 Strangman
4,884,820 A * 12/1989 Jackson et al. ..... 415/173.4
5,064,727 A 11/1991 Naik et al.
5,951,892 A * 9/1999 Wolfla et al. ..... 219/121.69
6,013,592 A 1/2000 Merrill et al.
6,197,424 B1 3/2001 Morrison et al.
6,203,021 B1 * 3/2001 Wolfla et al. ..... 277/415
6,235,370 B1 5/2001 Merrill et al.
6,589,600 B1 * 7/2003 Hasz et al. ..... 427/264
6,641,907 B1 11/2003 Merrill et al.
6,660,405 B2 12/2003 Lau et al.
6,670,046 B1 12/2003 Xia
6,706,319 B2 3/2004 Seth et al.
6,830,428 B2 12/2004 Le Biez
6,846,574 B2 1/2005 Subramanian et al.
6,946,208 B2 9/2005 Subramanian et al.
2006/0120874 A1 6/2006 Burke et al.
2006/0121265 A1 6/2006 Thompson
2006/0121296 A1 6/2006 Morrison et al.

* cited by examiner

*Primary Examiner*—Igor Kershteyn

(57) ABSTRACT

A pattern of depressions (36) in a sealing surface (34) on a CMC wall (32) of gas turbine ring segment (30) allows minimum clearance against turbine blades tips, and thus maximizes working gas sealing. An array of depressions (36) on the surface (34) increases abradability of the surface (34) by blade tip contact during zero clearance conditions and reduces blade tip damage. The depressions (36) are unconnected, preventing bypass of the working gas around the blade tips. A desired abradable surface geometry may be formed in a stacked laminate wall construction (40-43, 52) by staggered laminate edge profiles (50, 52) or by machining of depressions (36, 54) after construction.

16 Claims, 4 Drawing Sheets

ABRADABLE CMC STACKED LAMINATE RING SEGMENT FOR A GAS TURBINE

FIELD OF THE INVENTION

The present invention relates to abradable surfaces for high temperature applications, and more particularly relates to such surfaces on ceramic matrix composite (CMC) ring segments for combustion turbines.

BACKGROUND OF THE INVENTION

Some components of combustion turbines operate at high temperatures, and thus may require thermal barrier coatings (TBCs). Conventional TBCs typically comprise a thin layer of zirconia or other ceramic material. In some applications, the coatings must be erosion resistant and also abradable. Turbine ring seal segments must withstand erosion and must also have tight tolerances on a radially inward sealing surface opposed the tips of rotating turbine blades. To minimize these tolerances, the sealing surface of ring segments may be made abradable in order to reduce damage to the turbine blades upon occasional brushing contact of blade tips with the sealing surface.

Improvements in gas turbine efficiency rely on breakthroughs in several key technologies as well as enhancements to a broad range of current technologies. One of the key issues is a need to tightly control rotating blade tip clearance. This requires that turbine ring segments are able to absorb mechanical rubbing by rotating blade tips.

For modern conventionally cooled and closed loop steam cooled turbine ring segments, a thick thermal barrier coating of about 0.1 inch on the ring segment surface is required for rubbing purposes. The latest advanced gas turbine has a hot spot gas temperature of over 1,500 degrees C. at the first stage ring segment. Under such heat, a TBC surface temperature of over 1,300 degrees C. is expected. Thus, a conventional abradable TBC is no longer applicable because conventional TBCs are typically limited to a maximum surface temperature of about 1,150 degrees C.

Friable graded insulation (FGI) materials are disclosed in U.S. Pat. No. 6,641,907 commonly owned by the present assignee. The effectiveness of FGI as an abradable refractory coating is based upon control of macroscopic porosity in the FGI to deliver acceptable abradability. Such a coating may consist of hollow ceramic spheres in a matrix of alumina or aluminum phosphate. To bond an FGI layer to a metal ring segment, an FGI-filled metallic honeycomb structure has been proposed in U.S. Pat. No. 6,846,574 commonly owned by the present assignee. In this technique a high temperature metal alloy honeycomb is brazed to the metallic substrate. The honeycomb, once oxidized prior to FGI application, serves as a mechanical anchor and compliant bond surface for an FGI filler, and provides increased surface area for bonding.

Further advances in high temperature abradable surfaces for gas turbine ring segment surfaces are desired.

BRIEF DESCRIPTION OF THE DRAWINGS

The invention is explained in the following description in view of the drawings that show.

DETAILED DESCRIPTION OF THE INVENTION

A gas turbine component, especially a ceramic matrix composite (CMC) ring segment, is described herein with an abradable surface exposed to a hot gas flow. In contrast to prior art, no thermal barrier coating is applied to the exposed surface. Instead, the CMC itself is used as its own thermal barrier, but is modified to allow for abradability. The current invention provides an array of depressions directly in the CMC surface to increase its abradability, allowing occasional brushing contact with turbine blade tips with reduced wear on the blade tips. This technology is especially applicable to CMC ring segment walls formed by laminate construction, in which CMC layers are oriented edgewise in a stacked configuration.

Figure 1:
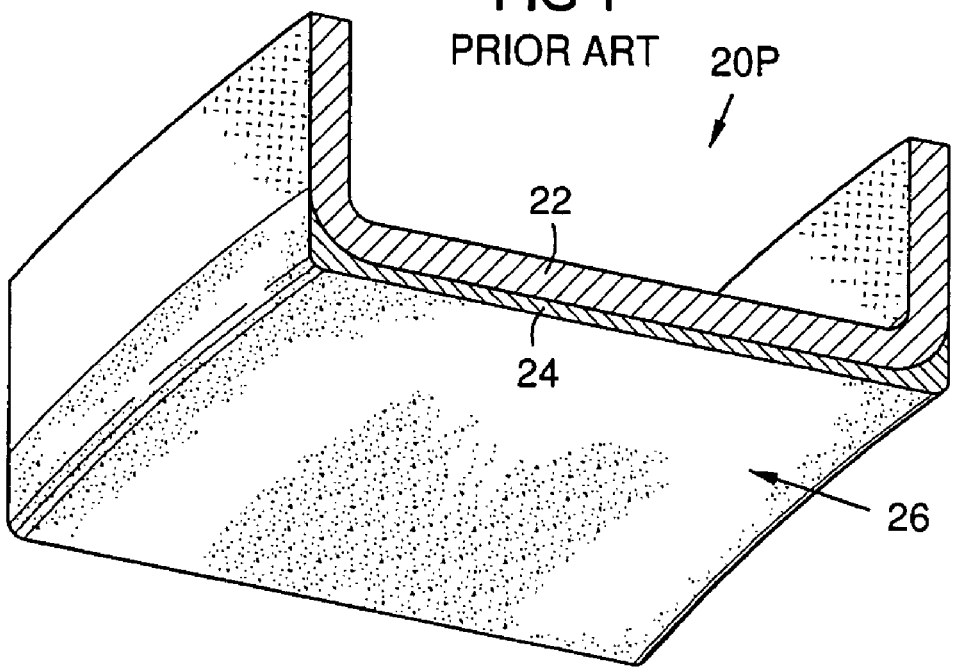
FIG 1 PRIOR ART
FIG. 1 is a sectional and perspective view of a prior art CMC wall for a gas turbine ring segment with a thermal barrier coating.
Figure 2:
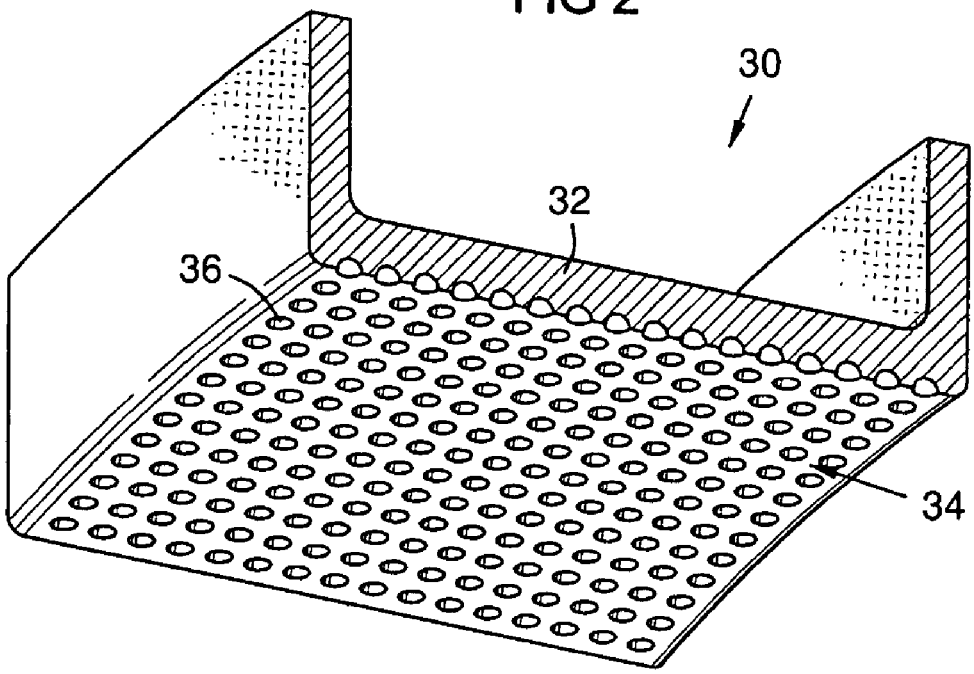
FIG. 2 is a sectional and perspective view of a CMC wall for a gas turbine ring segment with depressions providing an abradable sealing surface according to the invention.

FIG. 1 illustrates a CMC wall structure 22 of a prior art ring segment 20P that has a thermal barrier coating 24 such as FGI to provide an abradable gas flow sealing surface 26. FIG. 2 illustrates a CMC wall structure 32 of a ring segment 30 that has a sealing surface 34 with no coating, but with an array of depressions 36 according to aspects of the invention to increase the abradability of the surface 34. The depressions 36 are unconnected to each other in order to prevent bypass of the working gas around the blade tips via the depressions. They can be formed by removal of material from the CMC surface 34 after constructing and curing the wall 32, or they can be formed by laminate edge profiling, as next described. Material removal processes may include one or more known methods, such as milling, drilling, water jet cutting, laser cutting, electron beam cutting, and ultrasonic machining.

Figure 3:
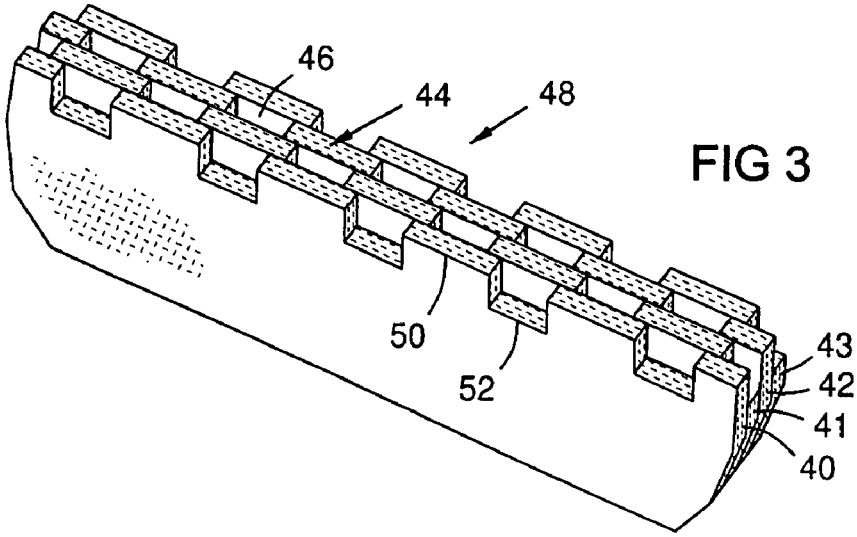
FIG. 3 shows CMC lamina having respective edges profiled with maxima and minima, and staggered in a stacked construction to form a CMC wall providing a sealing surface with depressions according to the invention.

FIG. 3 illustrates a CMC wall structure 48 formed by a stack of CMC layers (or lamellae) 40-43 with edge profiling 50, 52 that results in a surface 44 with unconnected depressions 46. Techniques for manufacturing such a stacked lamellate assembly are known in the art, such as discussed in commonly-assigned United States Patent Application Publications US 2006/0121265 and US 2006/0120874, both incorporated by reference herein. Each layer 40-43 has a respective edge that is profiled with alternating maxima 50 and minima 52 that may be formed onto the edge prior to joining of the lamellae together. The maxima 50 and minima 52 are staggered in alternating layers 40-43 so that the adjoining maxima 50 of one or several adjacent layers are substantially aligned with the adjoining minima 52 of one or several adjacent layers to form a plurality of unconnected depressions 46 in the surface 44. In the embodiment of FIG. 3, the maxima 50 and minima 52 both define a generally rectangular shape, with the relative absolute and relative depth and length dimensions of the rectangular shapes being selectable by the designer to optimize performance in any specific application. Typically, the dimensions of the depressions 46 may be 1.5-2.5 mm deep and up to 4 mm long (i.e. along the longitudinal axis of the lamella). Typically the length of the exposed maxima surface segment 50 may be 5-7 mm.

Figure 4:
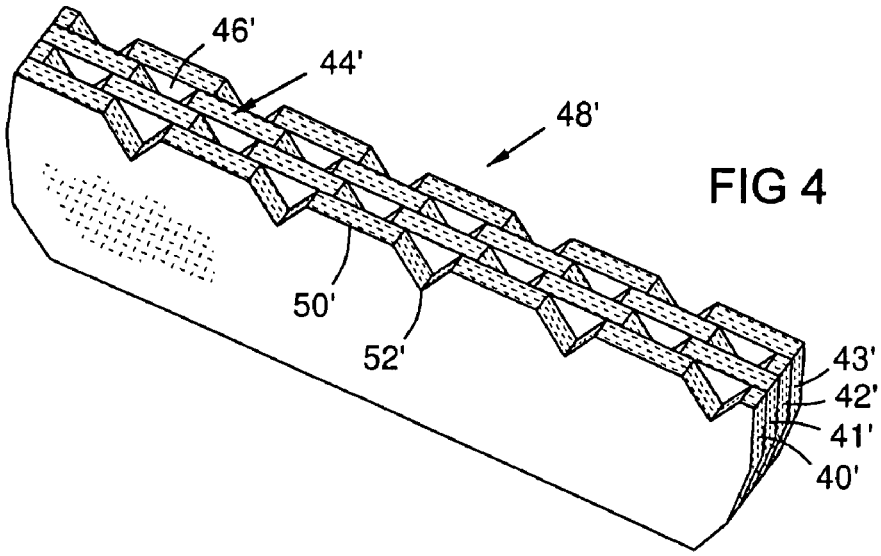
FIG. 4 shows a variation of the lamina edge shapes of FIG. 3.

FIG. 4 illustrates a variation of FIG. 3 in a CMC wall structure 48' formed by a stack of CMC layers 40'-43' with edge profiling 50', 52' that results in a surface 44' with unconnected depressions 46'. Each layer 40'-43' has a respective edge that is profiled with alternating maxima 50' and minima 52 that define a generally V-shape. The dimensions of the exposed surface segment 50' and the depth of the depression 46' may be similar to those described for the embodiment of FIG. 3.

Figure 5:
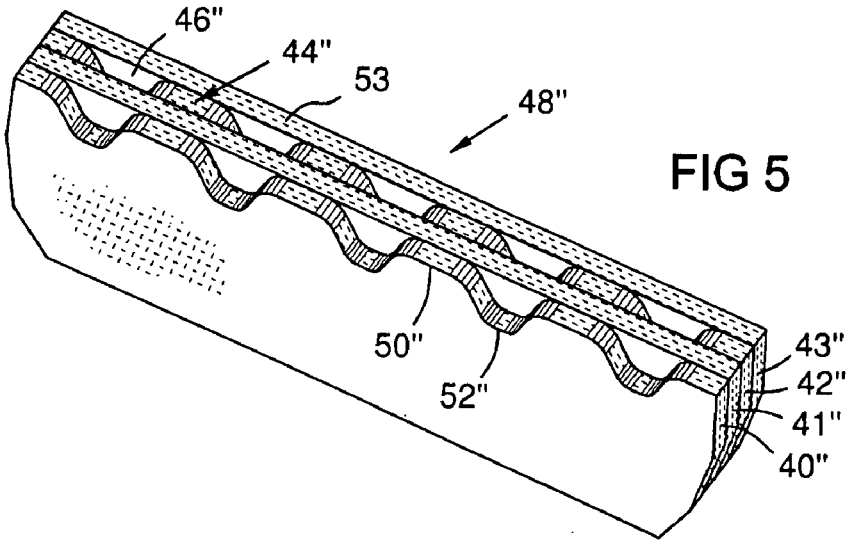
FIG. 5 shows CMC lamina in a first series having respective edges shaped with maxima and minima, a second series having respective edges that are generally level with the maxima of the first series, and the first and second series of the lamina alternating with each other in a stacked wall construction.

FIG. 5 illustrates a CMC wall structure 48" formed by a stack of CMC layers 40"-43" in which a first series 40" and 42" of the CMC layers has maxima 50" and minima 52", a second series 41" and 43" of the layers has respective edges 53 that generally match the level of the maxima 50" of the first series, and the first and second series of the layers 40"-43" alternates in the stack. In this embodiment the transition between the maxima 50" and minima 52" define a relatively smooth curved shape. The dimensions of the exposed surface segment 50" and the depth of the depression 46" may be similar to those described for the embodiment of FIG. 3. Other edge profiles and arrangements are possible. For example profiles similar to those of the first series of CMC layers 40" and 42" of FIG. 5 could be used in a staggered configuration as in FIGS. 3 and 4, and vice versa.

Figure 6:
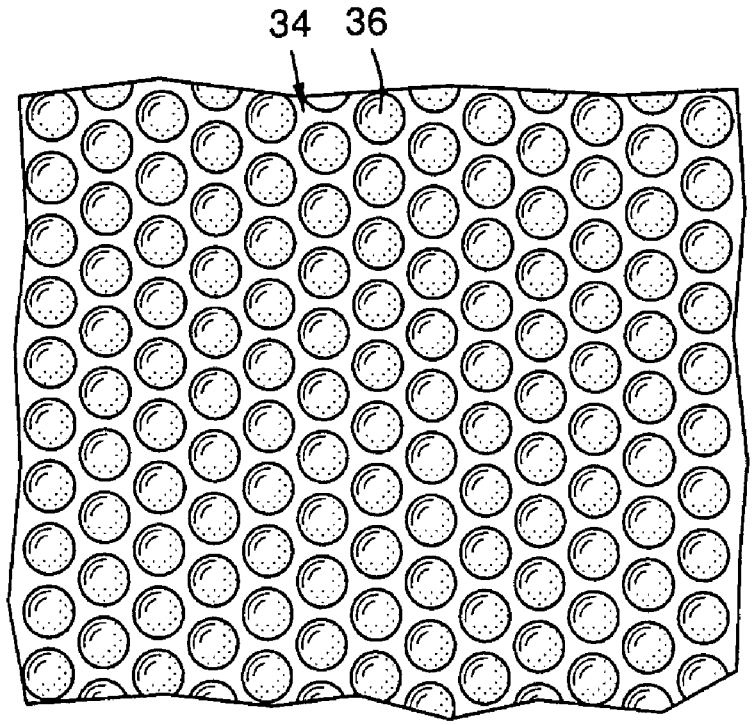
FIG. 6 shows an array of unconnected depressions, each with a generally circular opening geometry.

FIG. 6 illustrates an array of unconnected depressions 36 with circular openings in a surface 34, as may be formed by ball-end milling or other machining processes. The depressions 36 may have a spherical shape, or they may have a cylindrical shape proximate the surface 34 with a spherical bottom, or they may have a cylindrical shape throughout. Embodiments wherein depressions have a cross-sectional area that decreases with depth are effective to present an increasing wear surface area as the sealing surface is worn by abrasion, thereby facilitating the wear-in of the surface.

Figure 7:
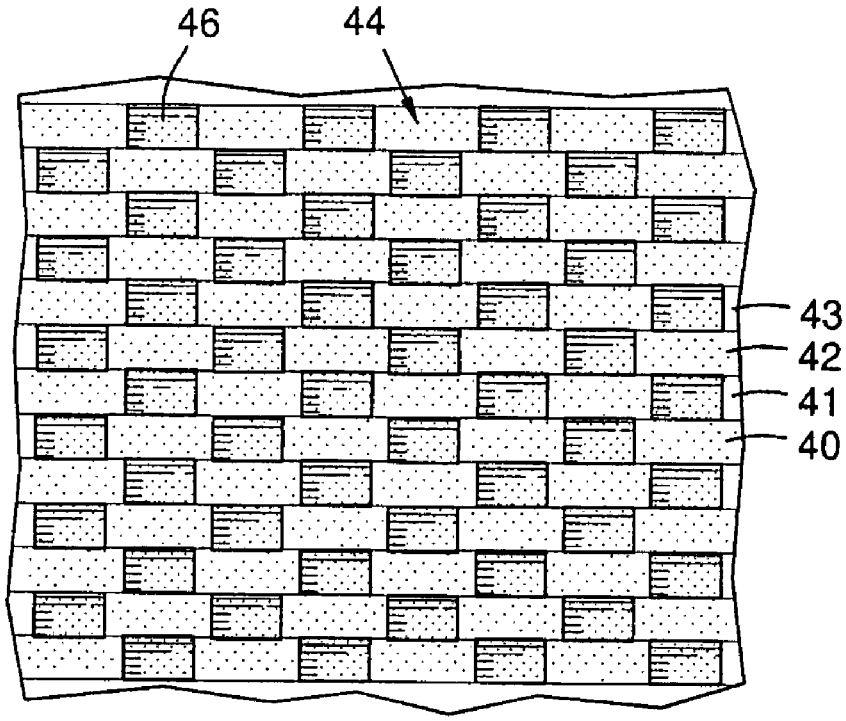
FIG. 7 shows an array of unconnected depressions, each with a generally rectangular opening geometry formed by lamina as in FIG. 3.

FIG. 7 illustrates an array of unconnected depressions 46 with rectangular openings in a surface 44 formed by a stacked laminate construction as in FIG. 3.

Figure 8:
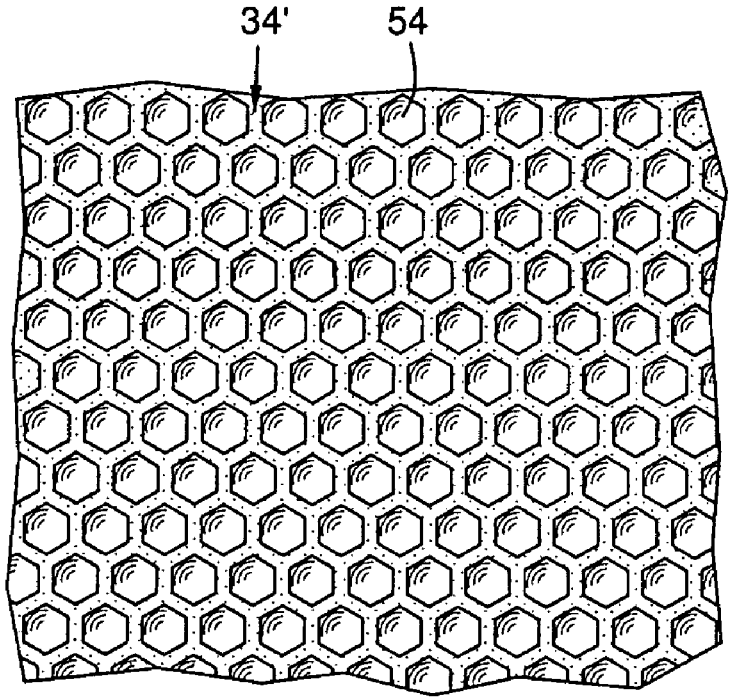
FIG. 8 shows an array of unconnected depressions, each with a generally hexagonal opening geometry.

FIG. 8 illustrates an array of unconnected depressions 54 with hexagonal openings in a surface 34', as may be formed by laser, water jet, or electron beam machining techniques.

Figure 9:
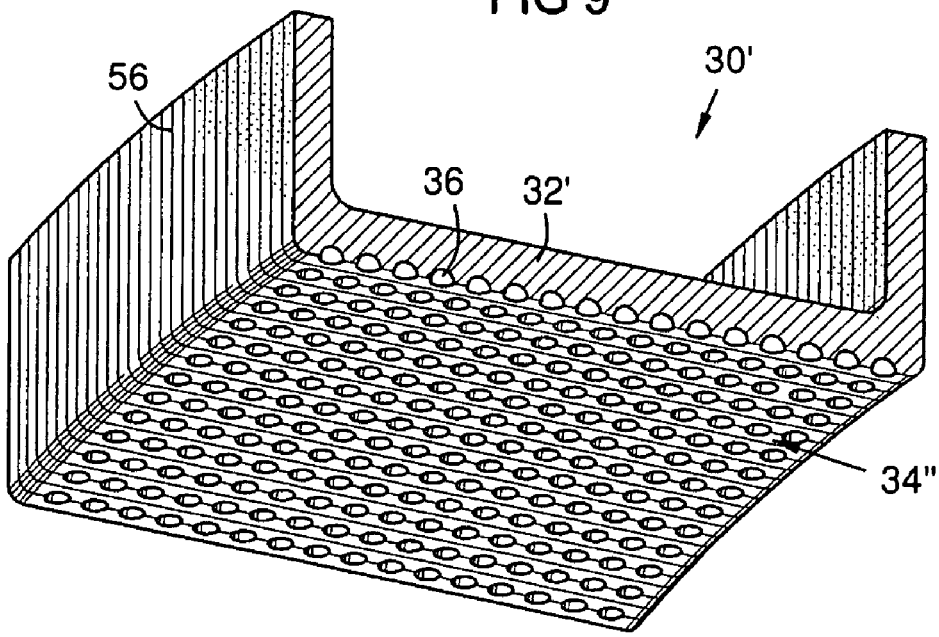
FIG. 9 is a sectional and perspective view of a CMC wall for a gas turbine ring segment formed by stacked laminate construction with depressions providing an abradable sealing surface.

FIG. 9 illustrates a turbine ring segment 30' with a CMC wall 32' formed by bonding and curing of stacked CMC lamellae 56. A gas sealing surface 34" on the wall 32' is subsequently machined with an array of depressions 36 according to the invention as in FIGS. 2 and 6 or in other shapes such as illustrated in FIGS. 3-5, 7 and 8.

Behavior of CMC exposed to high temperatures shows reduction in strength over long periods; however such a reduction in strength should not be limiting for the present invention because strength is not the material property of primary concern for a wear surface. Since a CMC surface 34, 44 in this invention is directly exposed to the hot working gas, it will be exposed to temperatures over 1200° C. This will reduce its strength but will also increase its hardness. The increase in hardness will beneficially reduce erosion of the surface. The surface may be allowed to age during operation of the gas turbine engine, or it may be pre-aged prior to being placed into operation. A thin, hard ceramic coating, for example alumina, may be applied to the CMC edges as temporary erosion protection until CMC hardening occurs.

The present invention eliminates the need for an abradable thermal barrier coating such as FGI, thus eliminating the associated bond joint and avoiding any concern about differential elasticity between the two materials. Accordingly, the invention is expected to provide improved component reliability and durability and reduced manufacturing expense compared to prior art coating methods.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A component for a gas turbine, the component comprising a CMC wall defining a hot gas flow sealing surface, the CMC wall formed of CMC lamellae oriented in a stacked lamellate configuration, and the sealing surface comprising a pattern of unconnected depressions effective to increase abradability of the sealing surface.

2. A component as in claim 1, wherein the pattern of unconnected depressions is formed by a pattern of alternating maxima and minima on respective edges of at least some of the CMC lamellae.

3. A component as in claim 2, wherein the minima comprise a generally rectangular shape.

4. A component as in claim 2, wherein the minima comprise a generally V-shape.

5. A component as in claim 2, wherein the minima comprise a generally smooth curved shape.

6. A component as in claim 2, wherein the respective edges comprise profiles of the alternating maxima and minima that are staggered in alternate CMC layers such that the maxima of a first edge substantially aligns with the minima of an adjacent second edge.

7. A component as in claim 2, wherein a first series of the lamellae comprises respective edges profiled with maxima and minima, a second series of the lamellae comprises respective edges generally level with the maxima of the first series, and the first and second series alternate with each other in the stacked lamellate configuration.

8. A component as in claim 1 wherein each of the depressions comprises a generally circular opening geometry.

9. A component as in claim 1 wherein each of the depressions comprises a generally rectangular opening geometry.

10. A component as in claim 1 wherein each of the depressions comprises a generally hexagonal opening geometry.

11. A component as in claim 1, wherein each depression comprises a cross-sectional area that decreases with depth, effective to present an increasing wear surface area as the sealing surface is worn by abrasion.

12. A method of constructing a CMC wall with an abradable gas sealing surface for a gas turbine component, the method comprising:

forming a plurality of CMC lamina that define the CMC wall when stacked;

stacking and joining the lamina together to form the CMC wall with a set of respective edges of the CMC lamina forming the gas sealing surface; and forming a pattern of unconnected depressions directly in the gas sealing surface of the CMC wall.

13. A method of constructing a CMC wall as in claim 12, wherein the pattern of unconnected depressions is formed by profiling the respective edges of at least some of the lamina with a pattern of alternating maxima and minima prior to the step of stacking and joining to form the gas sealing surface with the pattern of unconnected depressions when the lamina are stacked and bonded together.

14. A method of constructing a CMC wall as in claim 13, wherein the respective edges of adjacent lamina comprise substantially the same pattern of alternating maxima and minima, and wherein the maxima of each respective edge substantially aligns with the minima of each adjacent respective edge.

15. A method of constructing a CMC wall as in claim 13, wherein a first series of the lamina comprises respective edges profiled with maxima and minima, a second series of the lamina comprises respective edges generally level with the maxima of the first series, and lamina of the first and second series alternate with each other in the construction of the CMC wall.

16. A method of constructing a CMC wall as in claim 12, further comprising forming respective depressions to comprise a cross-sectional area that decreases with depth, effective to present an increasing wear surface area as the gas sealing surface is worn by abrasion.

* * * * *